US009243394B2

(12) United States Patent
Brown et al.

(10) Patent No.: US 9,243,394 B2
(45) Date of Patent: Jan. 26, 2016

(54) REPLACEABLE RESTROOM URINAL ASSEMBLIES, INCLUDING URINAL SCREENS

(71) Applicant: Fresh Products, Inc., Toledo, OH (US)

(72) Inventors: Douglas S. Brown, Toledo, OH (US); Jeffrey A. Smith, Toledo, OH (US)

(73) Assignee: Fresh Products, Inc., Toldeo, OH (US)

( * ) Notice: Subject to any disclaimer, the term of this patent is extended or adjusted under 35 U.S.C. 154(b) by 466 days.

(21) Appl. No.: 13/623,009

(22) Filed: Sep. 19, 2012

(65) Prior Publication Data

US 2013/0067651 A1 Mar. 21, 2013

Related U.S. Application Data

(60) Provisional application No. 61/536,923, filed on Sep. 20, 2011.

(51) Int. Cl.
*E03D 13/00* (2006.01)

(52) U.S. Cl.
CPC ..... *E03D 13/00* (2013.01)

(58) Field of Classification Search
USPC ..... 4/301, 495, 222.1–228.1; 116/308, 315, 116/319
See application file for complete search history.

(56) References Cited

U.S. PATENT DOCUMENTS

| | | | |
|---|---|---|---|
| 333,935 | A | 1/1886 | Duncan |
| 555,888 | A | 3/1896 | Roberts |
| 810,973 | A | 1/1906 | Pattenden et al. |
| 950,574 | A | 3/1910 | Morgan |
| 1,109,904 | A | 9/1914 | Dahlgren |
| 1,208,675 | A | 12/1916 | Sleight |
| 1,260,082 | A | 3/1918 | Sleight |
| 1,292,856 | A | 1/1919 | Niblo |
| 1,731,431 | A | 10/1929 | Meyer |
| 1,880,962 | A | 10/1932 | Koppelman |
| 1,886,676 | A | 11/1932 | Heuacker |
| 1,935,128 | A | 11/1933 | Pullman |
| 2,011,732 | A | 8/1935 | Saeks |
| 2,020,864 | A | 11/1935 | Aronson et al. |
| 2,087,592 | A | 7/1937 | Chesnut |

(Continued)

FOREIGN PATENT DOCUMENTS

| | | | |
|---|---|---|---|
| DE | 1915249 | A1 | 10/1970 |
| DE | 19541911 | A1 | 5/1997 |

(Continued)

OTHER PUBLICATIONS

GB 2431101.*

(Continued)

*Primary Examiner* — Lauren Crane
(74) *Attorney, Agent, or Firm* — Knobbe, Martens, Olson & Bear, LLP

(57) ABSTRACT

A urinal assembly having a screen body with a date feature corresponding to days, weeks, months, years, quarters or other time intervals. The date feature includes date tabs that may be removably attached to the screen body that may be removed or altered to indicate the desired date, such as a date of installation or expiry date of the urinal screen. The date feature and date tabs may be molded together with the remainder of the urinal screen body, forming a one piece construction made of a plastic material that may withstand the harsh environmental conditions within a urinal or toilet.

23 Claims, 12 Drawing Sheets

(56) References Cited

U.S. PATENT DOCUMENTS 2,211,970 A 8/1940 Fischer
2,233,234 A 2/1941 Wilson
2,447,178 A 8/1948 Hatchette
2,506,669 A 5/1950 Heuacker
2,508,808 A 5/1950 Warman
2,679,054 A 5/1954 Singleton
2,690,569 A 10/1954 Kozerski
2,931,047 A 4/1960 Stebbins
2,984,841 A 5/1961 Wilson
3,170,169 A 2/1965 Clark
3,237,330 A 3/1966 Dinstbir
3,248,740 A * 5/1966 Wisnom ..... 4/222.1
3,268,920 A 8/1966 Beer
3,329,998 A 7/1967 Stohr
3,387,069 A 6/1968 Stohr
3,422,558 A 1/1969 Fee
3,540,433 A 11/1970 Brockman
3,597,772 A 8/1971 Lincolnwood et al.
3,614,790 A 10/1971 Billingsly et al.
3,631,560 A 1/1972 Atkins
3,723,998 A 4/1973 Wehr
3,752,121 A 8/1973 Brazzell
3,760,429 A 9/1973 Brownstein
3,788,485 A 1/1974 Bruning
3,804,796 A 4/1974 Alexandre
3,824,633 A 7/1974 Vlahakis
3,837,988 A 9/1974 Hennen et al.
3,867,953 A 2/1975 Stohr
3,899,192 A 8/1975 Reddaway
3,923,442 A 12/1975 Stohr
3,935,602 A 2/1976 Kale
4,010,497 A 3/1977 Menter et al.
4,095,031 A 6/1978 Engle
4,103,367 A 8/1978 Kaufer
4,212,153 A 7/1980 Kydonieus et al.
4,215,443 A 8/1980 Babik
D258,181 S 2/1981 Adam
D258,472 S 3/1981 Adam
4,305,216 A 12/1981 Skelton
4,361,606 A 11/1982 Butler et al.
4,389,963 A 6/1983 Pearson
4,405,509 A 9/1983 Rogers et al.
4,408,557 A 10/1983 Bradley et al.
4,418,432 A 12/1983 Vidal
4,440,542 A 4/1984 Foley
4,490,862 A 1/1985 Vidal
4,515,909 A 5/1985 Sawano et al.
D280,267 S 8/1985 Bryant et al.
4,549,693 A 10/1985 Barlics
4,557,863 A 12/1985 Callewaert et al.
4,574,400 A 3/1986 Annowsky
4,574,403 A 3/1986 Dintemann et al.
4,604,357 A 8/1986 Callewaert et al.
4,612,676 A 9/1986 Whitman
4,671,976 A 6/1987 Vidal
4,750,219 A 6/1988 Williams
4,761,437 A 8/1988 Christie
4,815,767 A 3/1989 Lambert
4,830,407 A 5/1989 Sadler, Jr. et al.
4,866,793 A 9/1989 Luedtke et al.
4,941,688 A 7/1990 Jones
4,985,940 A 1/1991 Jones
5,010,599 A 4/1991 Nilsson
5,019,434 A 5/1991 Matsumoto
5,058,088 A 10/1991 Haas et al.
5,058,523 A 10/1991 Mikkonen et al.
5,087,273 A 2/1992 Ward
5,117,515 A 6/1992 White, Jr. et al.
5,139,864 A 8/1992 Lindauer
D329,893 S 9/1992 Luedtke et al.
5,150,481 A 9/1992 Pang
5,150,722 A 9/1992 Rutherford
5,165,119 A 11/1992 Yamato
5,188,755 A 2/1993 Chang
D341,414 S 11/1993 Baker
5,309,578 A 5/1994 Temple, Sr.
5,313,672 A 5/1994 Luedtke et al.
5,336,424 A 8/1994 Vlahakis et al.
5,364,132 A 11/1994 Haas et al.
5,365,616 A 11/1994 Morad
5,377,362 A 1/1995 Jackson
5,398,347 A 3/1995 Luedtke et al.
5,472,712 A 12/1995 Oshlack et al.
5,479,735 A 1/1996 Martin, Jr.
5,482,007 A 1/1996 Kumlin
5,489,415 A 2/1996 Vlahakis et al.
5,496,300 A 3/1996 Hirsch et al.
D370,938 S 6/1996 Roach
5,556,685 A 9/1996 Swicegood, Jr.
5,580,578 A 12/1996 Oshlack et al.
5,604,937 A 2/1997 Davenport
5,639,476 A 6/1997 Oshlack et al.
5,660,138 A * 8/1997 Hirsch ..... 116/308
5,719,828 A 2/1998 Haas et al.
D393,896 S 4/1998 Wagner et al.
5,774,905 A 7/1998 Wager et al.
5,809,590 A 9/1998 Williams et al.
5,813,058 A 9/1998 Quigley et al.
5,867,848 A 2/1999 Ort
5,885,701 A 3/1999 Berman et al.
5,958,334 A 9/1999 Haddon
5,961,148 A 10/1999 Cheng
D422,061 S 3/2000 Lee
6,055,681 A 5/2000 Lyons
D427,295 S 6/2000 Wagner
6,079,975 A 6/2000 Conover
6,081,937 A 7/2000 Whitacre
6,103,201 A 8/2000 Green
6,103,351 A 8/2000 Ram et al.
6,113,148 A 9/2000 Koranda et al.
D438,710 S 3/2001 Chen
6,207,236 B1 3/2001 Araki et al.
6,213,409 B1 4/2001 Warren et al.
D442,246 S 5/2001 McCabe et al.
6,244,208 B1 6/2001 Qiu et al.
6,265,084 B1 7/2001 Stickler
6,279,759 B1 8/2001 Weisbach
D456,492 S 4/2002 Lourens
6,370,705 B1 4/2002 Levinson
D464,122 S 10/2002 Mangan
6,517,759 B1 2/2003 Ferenc et al.
6,640,350 B1 11/2003 Deutsch
6,698,035 B1 3/2004 Grueser
6,703,012 B1 3/2004 White
6,730,311 B2 5/2004 Maleeny et al.
6,787,210 B2 9/2004 Stickler
6,823,533 B2 11/2004 Casari
6,862,754 B1 3/2005 DeMarco
6,920,648 B1 7/2005 Suski et al.
6,927,199 B2 8/2005 Takemura et al.
6,988,462 B1 1/2006 Zhu
D520,610 S 5/2006 Wrate
7,061,831 B2 6/2006 De La Huerga
7,127,844 B2 10/2006 Collins
7,202,201 B1 4/2007 Williams
7,413,082 B2 8/2008 Adler et al.
7,419,588 B2 9/2008 Lawson
7,434,535 B2 10/2008 Adamy
D598,075 S 8/2009 Uhl
7,742,367 B2 6/2010 Haas
7,808,861 B2 10/2010 Wien
7,904,972 B2 3/2011 Anderson
7,921,479 B2 4/2011 Hunter
7,921,583 B2 4/2011 Londino
D639,410 S 6/2011 Ramirez
8,043,498 B2 10/2011 Rueda
D678,482 S 3/2013 Williams
D678,483 S 3/2013 Barker
D682,398 S 5/2013 Lee
8,856,977 B2 10/2014 Ramirez
2003/0044326 A1 3/2003 Yamasaki et al.
2005/0022298 A1 2/2005 De Leon et al.
2005/0067106 A1 3/2005 Melges
2005/0112339 A1 5/2005 Sandel et al.

(56) References Cited

U.S. PATENT DOCUMENTS

| | | | | |
|---|---|---|---|---|
| 2005/0144711 | A1 | 7/2005 | Valadez et al. | |
| 2005/0169793 | A1 | 8/2005 | Wheatley et al. | |
| 2005/0245671 | A1 | 11/2005 | Moon et al. | |
| 2005/0283892 | A1 * | 12/2005 | Simeone et al. | 4/309 |
| 2006/0232059 | A1 | 10/2006 | Fortune et al. | |
| 2007/0023539 | A1 | 2/2007 | Brown et al. | |
| 2007/0039089 | A1 | 2/2007 | Worrel | |
| 2007/0161927 | A1 | 7/2007 | Daugirdas | |
| 2007/0186337 | A1 | 8/2007 | Emr | |
| 2008/0098505 | A1 | 5/2008 | Casari | |
| 2008/0100057 | A1 | 5/2008 | MacPhee | |
| 2008/0292509 | A1 | 11/2008 | D'Amico | |
| 2009/0070923 | A1 | 3/2009 | Ruedas | |
| 2009/0229511 | A1 * | 9/2009 | Campbell et al. | 116/308 |
| 2009/0255053 | A1 | 10/2009 | Cutrone, III | |
| 2010/0183694 | A1 | 7/2010 | Burke et al. | |
| 2014/0007336 | A1 | 1/2014 | Mills et al. | |

FOREIGN PATENT DOCUMENTS

| | | | | |
|---|---|---|---|---|
| FR | 2681232 | A1 | | 3/1993 |
| GB | 189518394 | A | | 0/1896 |
| GB | 2431101 | A | * | 4/2007 |
| JP | 57-17599 | | | 1/1982 |
| JP | 60-178497 | | | 11/1985 |
| JP | 60-190865 | | | 12/1985 |
| JP | 63-116585 | | | 7/1988 |
| JP | 1990-102625 | A | | 4/1990 |
| JP | 1992-119880 | U | | 10/1992 |
| JP | 2001-303642 | | | 10/2001 |
| KR | 0368846 | U | | 11/2004 |

OTHER PUBLICATIONS

Dugdale, David C., "Uroflometry" MedlinePlus Medical Encyclopedia, 2008. http://www.nlm.nih.gov/medlineplus/ency/article/003325.htm, retrieved on Oct. 28, 2014 in 2 pages.

Gray, Henry. "The Male Urethra". Anatomy of the Human Body, 3b. 4, 1918. http://www.bartleby.com/107/256.html, retrieved on Oct. 27, 2014 in 5 pages.

Ritter, R. C. et al., "Analysis of Drop Intervals in Jets Modelling Obstruction of the Urinary Tract," Physics in Medicine and Biology, 1974, vol. 19, No. 2, 161-170, in 11 pages.

Ritter, R. C. et al., "Physical Information in the External Urinary Stream of the Normal and Obstructed Adult Male," British Journal of Urology, 1977, vol. 49, 293-302, in 10 pages.

* cited by examiner

REPLACEABLE RESTROOM URINAL ASSEMBLIES, INCLUDING URINAL SCREENS

RELATED APPLICATIONS

The present application claims priority under 35 U.S.C. §119(e) to U.S. Provisional Patent Application Ser. No. 61/536,923, filed Sep. 20, 2011. The above-referenced application is hereby incorporated by reference herein in its entirety.

FIELD OF THE INVENTION

Certain embodiments discussed herein relate to restroom screens and mats, and, more particularly, the present invention relates to replaceable restroom urinal screens and mats.

DISCUSSION OF THE RELATED ART

Urinal screens are widely used as air fresheners and to prevent debris from being flushed down a urinal drain. Urinal mats are sometimes used beneath urinals to catch fluids from the urinals, thereby making the floor a safer and more sanitary environment. In some cases, a fragrance is provided with the screens and mats to help sanitize and freshen the air in and around the urinal.

Both the screens and the mats are exposed to large amounts of human waste, flush water, and cleaning chemicals. This environment is harsh on restroom urinal screens and floor mats, and they can quickly deteriorate in such an environment. As a result of deterioration, urinal screens and mats can quickly lose their air freshening or sanitizing function, become torn so that debris is permitted through them, or become unsightly. Therefore, both screens and mats should be changed periodically for them to function properly without drawing undue attention.

In general, certain products are provided with expiration labels or other "best if used by" printed materials to provide product expiration dates—for example, milk cartons, batteries, canned foods, etc. In a retail environment, the expiration dates are decided by manufacturers providing the merchandise.

However, if printed expiration labels were applied to urinal screens and mats, the printed labels would likely be unsuitable and ineffective, as they would likely be washed away during the life-cycle of the product. Floor mats may also be damaged by foot traffic that can damage or wear away at labels. Further, the environmental conditions within and around urinals would tend to disintegrate the labels themselves and erode away any marking on the labels (e.g., the marking of a change date with a pen). It is also important to note that it is not meaningful to add the in-use expiration date to the product at the manufacturer level because when the urinal screens and mats are unopened, they have a very long shelf life. In practice, it is common for a customer to unpackage and install some of their purchased screens within a couple of weeks of manufacture and then unpackage and install the remainder many months later. Similarly, different customers may purchase the same batch of urinal screens from the manufacturer, but while one customer may unpackage and immediately install the urinal screens, another customer who purchased from the same batch may wait many months before opening and using them. The only thing the manufacturer can add is the total expected expiration date (which is perhaps about two years from manufacture), but that does not help the user/installer once the product is opened and installed.

One aspect of the invention is the recognition that for urinal screens and other urinal assemblies, usually it is the end user (the installer—or their manager) who is in the best position to determine the expiration date, or changing date, of the product. While urinal screens and mats may be designed to last a certain amount of time, amount of uses, or number of flushes, the end user is likely the best person to decide when to change out the urinal screen or mat. The specific decision to change out a urinal screen or mat may be based on parameters such as: desired air freshening quantity; desired performance; or, desired appearance. This decision may be based on observation and experience, or it may be based on metrics, such as data from a restroom cleaning/servicing chart commonly found on the back of the door of a public restroom.

In one embodiment, a urinal assembly comprises a screen body sized and shaped to be placed in a urinal, the screen body defining at least one opening, and a date feature comprising at least one date tab associated with indicia corresponding to a time or time interval, wherein the at least one date tab is removably attached to the screen body.

In another embodiment, a urinal assembly comprises a screen body sized and shaped to be placed in a urinal, the screen body defining at least one opening associated with indicia corresponding to a time or time interval, and a pin sized and shaped to be secured within the at least one opening.

In another embodiment, a urinal assembly comprises a mat body sized and shaped to be placed on a floor, and a date feature comprising at least one date tab associated with indicia corresponding to a time or time interval, wherein the at least one date tab is removably attached to the mat body.

One method of manufacturing a urinal assembly comprises the steps of providing a plastic that resists damage or alteration due to the environmental conditions within a urinal, loading the plastic with fragrance material to produce a fragranced plastic, wherein the loading occurs at a stage conducted at temperatures such that the fragranced plastic contains a predetermined amount of weight fragrance upon completion of the stage, molding the fragranced plastic into a urinal screen, forming openings in the screen body, and forming date tabs associated with indicia corresponding to a time or time interval.

Certain embodiments disclosed herein provide a solution to determine when restroom urinal screens and mats have been installed or are required to be removed before they lose their fragrance, structurally deteriorate, or generally lose their ability to perform. Some embodiments incorporate a date recording feature to make it easy to orderly record, represent, integrate, and verify dates and maintenance schedules relating to the urinal screen or mat. Upon installation of restroom urinal screens and mats, a facilities maintenance provider and its staff should be able to easily establish, change, extend, and verify proper date features for replacement of these products.

BRIEF DESCRIPTION OF THE DRAWINGS

The present invention is described with reference to the accompanying drawings, in which like reference characters reference like elements, and wherein.

DETAILED DESCRIPTION OF THE INVENTION

Figure 1:
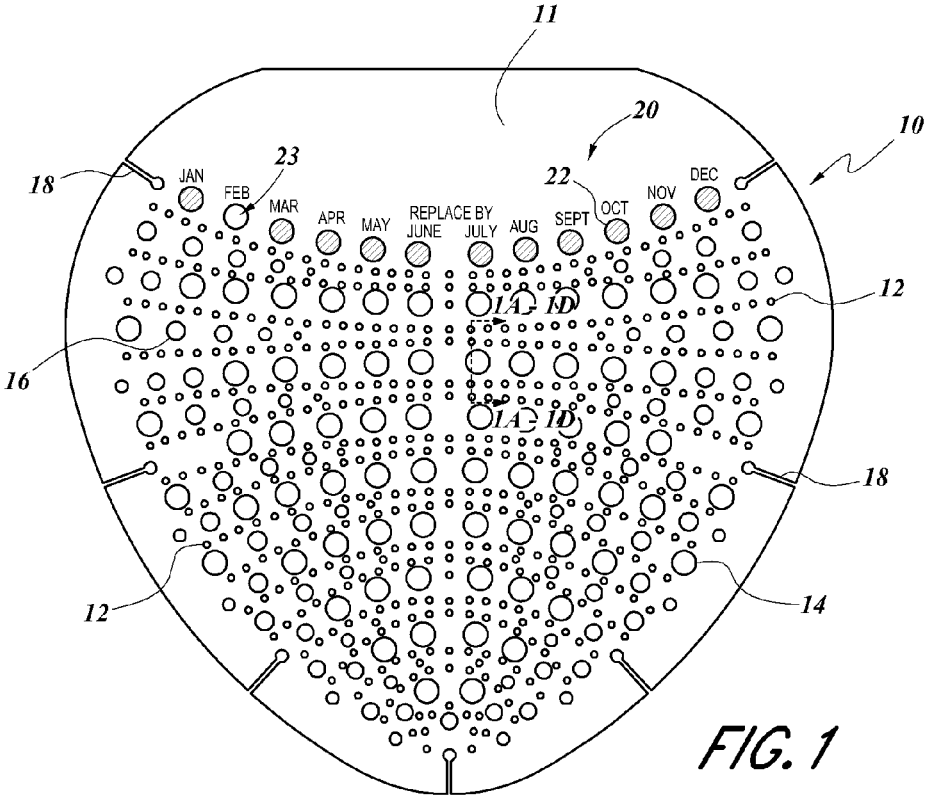
FIG. 1 is a plan view of an embodiment of a urinal screen having a date feature that has month tabs.
Figure 1A:
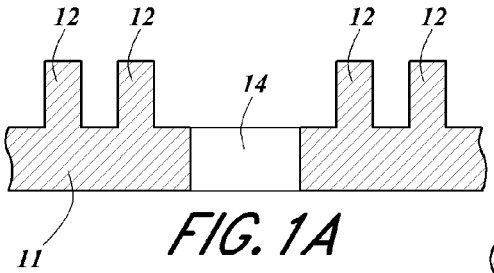
FIGS. 1A-1D are cross sectional views of section 1A-1D in FIG. 1, showing various embodiments relating to openings and protrusions of the urinal screen.
Figure 1B:
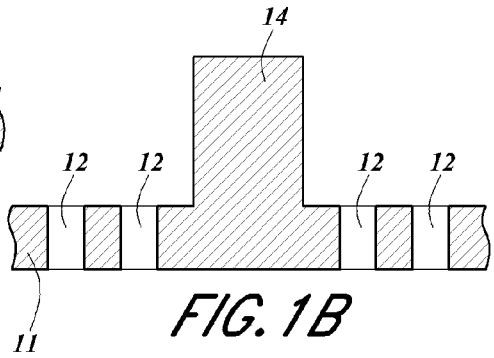
Figure 1C:
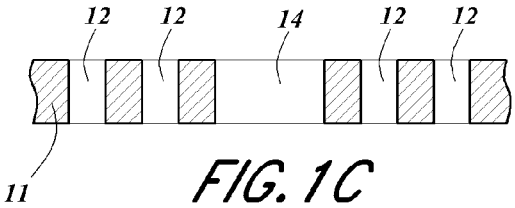
Figure 1D:
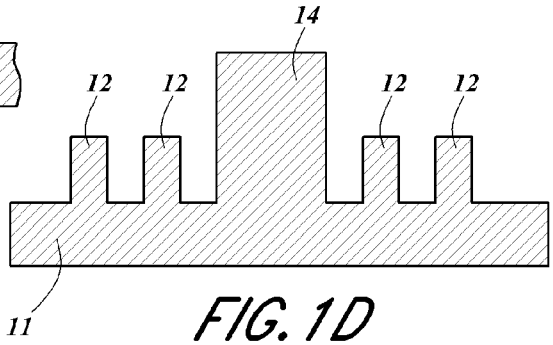

An embodiment of a urinal screen 10 is depicted in FIG. 1. The urinal screen has a screen body 11 that may be sized and shaped to be placed in a urinal or toilet. The screen body 11 may be sized and shaped to be placed over a portion or the entire portion of a drain of a urinal or toilet. For example, the body 11 may have a rounded triangular shape with a narrow, somewhat pointed front end 13 and a broader, flatter rear end 15, or the body 11 may have a circular, oblong, square, rectangular, or polygonal shape. The screen body 11 may have openings or protrusions 12, 14 and 16. In one embodiment, the openings 12, 14 and 16 are openings, or drain holes, which allow fluids to pass through the urinal screen 10 and be drained away from a urinal. In another embodiment, protrusions 12, 14 and 16 may be protrusions that extend from the surface of the screen body 11. The openings or protrusions 12, 14 and 16 may vary in size, shape, and pattern. Several embodiments of openings and protrusions are shown in FIGS. 1A-1D. For example, FIG. 1A shows one embodiment where the screen body 11 has protrusions 12 and openings 14; FIG. 1B shows another embodiment where the screen body 11 has protrusions 14 and openings 12; FIG. 1C shows another embodiment where the screen body 11 has openings 12 and 14; and, FIG. 1D shows another embodiment where the screen body 11 has protrusions 12 and 14. The screen body 11 may also have periphery slits 18 (or notches) that cooperate with the resilient body 11 and help to hold the screen 10 in position in the urinal/toilet over a drain (not shown), a portion of a drain, or another portion of the urinal or toilet. Another function of the periphery slits 18 is to prevent cupping, or warpage, if and when the urinal screen 10 shrinks during the manufacturing process. These periphery slits 18 may be located around the periphery of the screen body 11. The openings or protrusions 12, 14, 16 and slits 18 are not present on all embodiments of the screen body. Further, these openings or protrusions 12, 14, 16 and slits 18 may have a shape, pattern or size as illustrated, but these openings are not so limited in all embodiments.

The openings or protrusions, 12, 14, 16 and slits 18 may assist the screen 10 to conform to the urinal or toilet and to provide a good fit. For example, the openings 12, 14, 16 may prevent the screen 10 from floating in the urinal or toilet. Further, the slits 18 may assist the screen 10 to lock or be held in place when positioned within the urinal or toilet, especially in or around the drain area, and are helpful because of the curved design of the drain area of most urinals and toilets. For example, if the urinal screen floats over the drain portion instead of being seated on top of the drain portion, it may permit solid wastes to enter the drain portion, potentially clogging the drain.

The protrusions 12, 14 and 16 assist in keeping the urinal/toilet, the user, and restroom area clean. The protrusions 12, 14 and 16 are generally formed vertically with respect to the screen body 11 and assist in breaking up the force of the urine stream, thereby reducing splash and keeping the urine inside the urinal. The protrusions 12, 14 and 16 are located substantially across the screen body 11, increasing the surface area. With the protrusions 12, 14 and 16, Applicants have noticed decreased splashback onto the user, other parts of the urinal/toilet, and the restroom floor. Applicants have also noticed that urinal screens with flat surfaces generally reflect back the urine and cause greater splash to the urinal/toilet, user, and restroom floor. The protrusions 12, 14 and 16 can also break up the force of the flushing water, and any other liquids, including cleaning solutions that may be introduced into the urinal or toilet, thereby keeping the urinal, toilets and restroom floor cleaner in those situations. Further, the protrusions 12, 14 and 16 may be the same or different color as the screen body 11, may have the same or different surface texture as the screen body, and may be the same or different material as the screen body 11.

The embodiment shown in FIG. 1 also has a date feature 20 or indicia having multiple alphabetic date tabs 22 that are individually identified, for example, as JAN, FEB, MAR, APR, MAY, JUNE, JULY, AUG, SEPT, AUG, NOV, and DEC, or other indicia, which in this example, correspond to the twelve months of a year. The date tabs 22 may also be associated with other time intervals, such as days, dates, weeks, months, years, quarters, or any other time interval. These time intervals may be represented by numbers, figures, pictures, letters, or abbreviations. In one embodiment, the date tabs 22 are arranged in a curvilinear fashion at the rear end of the upper surface of the screen body 11. By arranging the date tabs 22 in the curvilinear fashion, it may be possible for them to be seen more easily once the screen 10 is installed in a urinal because, typically, the screen 10 rests on curved surfaces within the urinal. Further, an additional indicator tab or tabs (not shown) may be added to the screen body to indicate whether the date indicated by the date tabs 22 refers to an installation date or a expiry (or removal) date.

The date tabs 22, generally shown as shaded in FIG. 1, may be of the same or a different color as the screen body 11, may have the same or different surface texture as the screen body 11, and may be made of the same or different material as the screen body 11. The date tabs 22, and corresponding text relating to the days, dates, weeks, months, years, quarters, or other time intervals, and various instructions may be molded in or stamped into the urinal invention screens and mats. In some embodiments, the date tabs 22 may be molded in or co-molded with the remainder of the screen body 11, thereby forming a unitary structure or one-piece construction. In other embodiments, the date tabs 22 may be molded separately from the screen body 11, and secured onto the screen body at a later step to form a multiple-piece construction. For example, the date tabs 22 may be separately adhered onto the screen body 11 using an adhesive or tape, or they may be welded (e.g., by ultrasonic welding) to the screen body 11.

Figure 3:
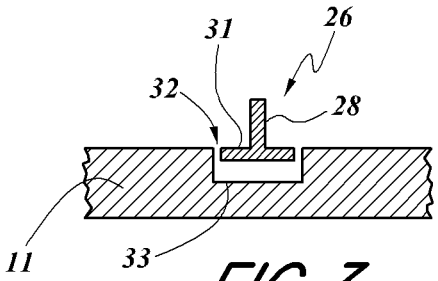
FIG. 3 is a cross-sectional view of section 3 in FIG. 2, showing an embodiment relating to pull tabs.
Figure 4A:
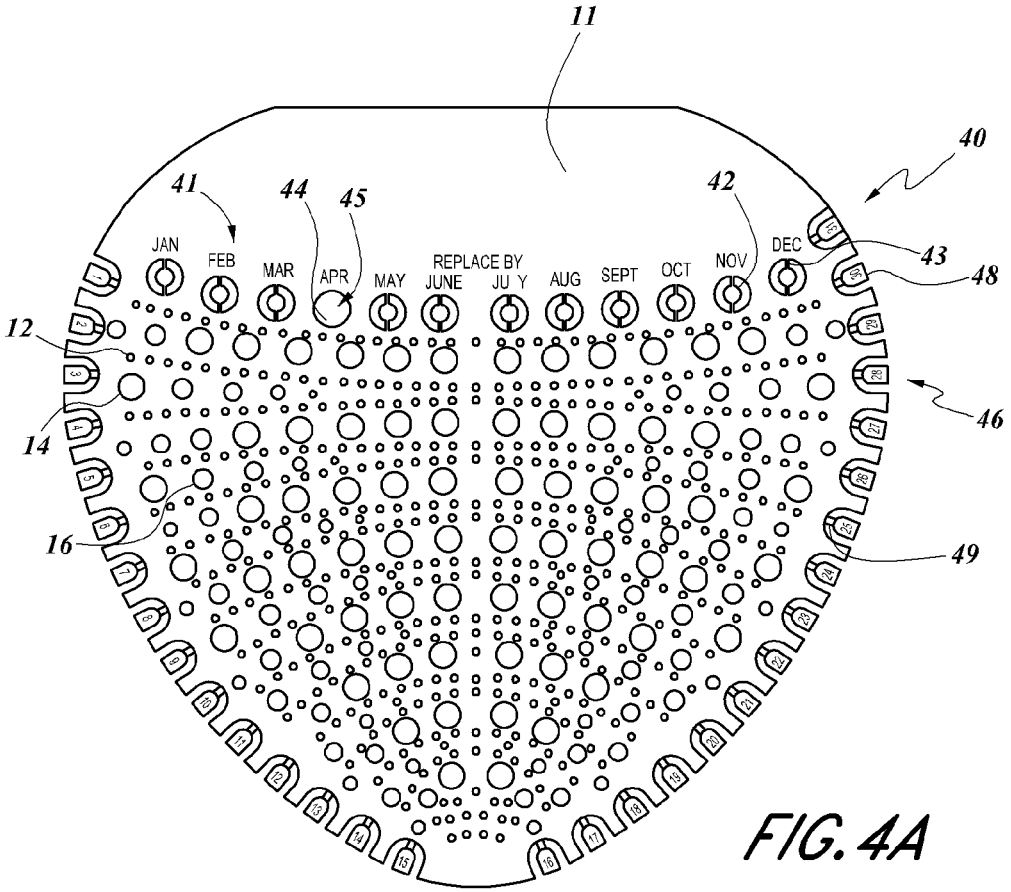
FIG. 4A is a plan view of an embodiment of a urinal screen having a date feature that has month and day tabs.
Figure 8A:
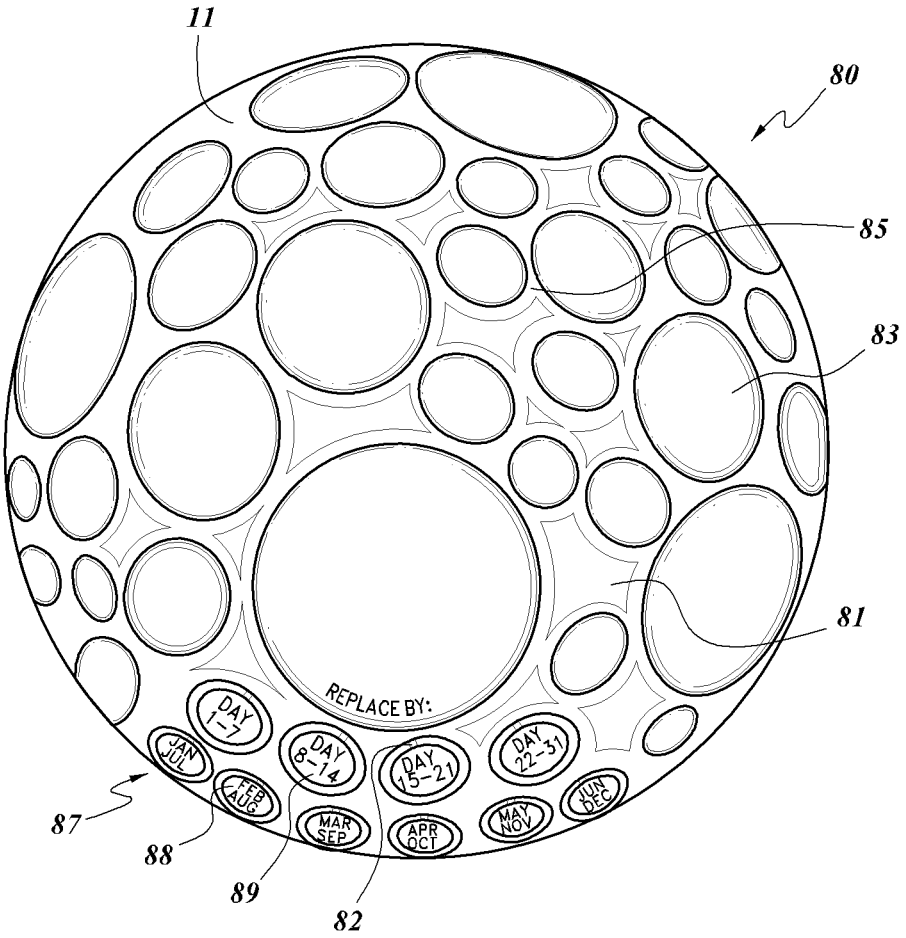
FIG. 8A is a plan view of an embodiment of a urinal screen having a date feature that has month and day tabs.

In some embodiments, the date tab may not be an actual tab, but rather may be a portion of a perforated cutout or hole. For example, date tab 22 shown in FIG. 1 is a circular portion that may be removed or displaced with respect to its original hole. One advantage of this example is the simplicity of the construction, i.e., the date tabs may be formed by perforating the cutouts or holes, without the need to mold other structures such as ribs or webbing. Also, the date tabs may be easier to remove in this example that in other example where the date tabs are attached by ribs or webbing. In other embodiments, the date tab may be an actual tab that provides a surface for a finger or tool to grasp, and the date tab is connected to the urinal assembly 11, and may be removed or displaced. For example, FIG. 4A shows an example of date tabs 48 that have a tabular structure. In this example, an advantage is the ease of grasping and removing the date tab due to the tabular design. In other embodiments, the date tab may have additional surfaces or members to facilitate removal or displacement. For example, FIG. 3 shows an example of a date tab 26, having a pull tab 28. One advantage of this example is further ease of grasping and removal due to the additional surfaces of a pull tab. In other embodiments, the date tab may be attached to the urinal assembly or perforated in a manner such that it may act as a flap. For example, FIG. 8A shows an example of a date tab 89 that is attached to the urinal body by a rib or webbing 82. In this example, the date tab may be removed by breaking the rib or webbing 82, but the date tab may also be folded away or displaced, such that the date tab 89 acts as or resembles a flap.

As described in these examples above, removal may require: cutting, twisting or breaking away a rib, webbing, or other supporting members; peeling away the date tab to dislodge or dislocate the date tab from an adhesive or weld; pulling the date tab with one's own fingers or with the use of a tool; or pushing or poking the date tab with one's own fingers or a tool. As described in these examples, displacement is similar to removal, except that the date tab may not be entirely separated from the urinal assembly, for example, the date tab may still be attached to the urinal assembly (or may be partially removed), but its appearance, location, position, shape, or size may be altered from its original state.

In the embodiment shown in FIG. 1, the date tab 22 for FEB has been removed. The date tab 22 may be perforated from the screen body 11, such that the FEB date tab 22 (not shown) may be pushed through, for example, by way of a pencil, or pulled off, or cut off with a knife. The separated date tab 22 could then be discarded, thereby revealing an opening 23 (the unshaded portion within the circle) through the screen body 11. This may indicate to a viewer that either the screen 10 needs to be changed in February or that the screen 10 was installed in February, depending on the facilities maintenance provider's policy. This may provide a visual cue to a user of the urinal/toilet, that replacement of the urinal screen occurred recently or will be replaced soon, depending on the maintenance scheme. It is important to note that the date tab 22 is typically removed by the installer, or possibly the supervisor of the installer, and usually not by the manufacturer of the urinal. The date feature 20 to allows an installer to pick the day, date, week, month, year or quarter to be shown on the urinal screen 10, which is based upon a maintenance/replacement scheme decided by the facilities maintenance provider, or perhaps recommended by the manufacturer of the screen 10. This may be different than products with expiry dates, such as milk cartons or canned foods, where the food is deemed to be inconsumable after a certain date. The urinal screen and any associated fragrance (if any) will likely not spoil like food until the urinal screen is put into service, or at least removed from its packaging. Therefore, it is likely that the person in the best position to determine an "expiry" date is that of the installer (or end user), and not the manufacturer. However, the manufacturer can also pre-date the urinal screens 10 for their customers. For example, if a large customer (such as a hospital or university) wishes to purchase a large quantity of screens 10 from a manufacturer, the manufacturer may recommend that the screen be changed out every three months regardless of use. Thus, the manufacturer may send newly made batches of the pre-dated urinal screens to the customer periodically, for example, with a date feature that already indicates January 1, April 1, July 1, and October 1. Upon receipt from the manufacturer (e.g., on October 2), the customer can replace all of their urinal screens and the screens will indicate the next expiry date (e.g., January 1).

Some advantages of the date feature 20 relate to knowledge of the age or installation/expiry date of the urinal screen 10. In some embodiments, because the date feature 20 and date tabs 22 may be molded-in or co-molded with the screen body 11, and may be made of the same material as the screen body 11, the date feature will be very durable (likely at least as durable as the screen body 11), and capable of resisting the harsh environment within a urinal, which may contain urine, waste products, cleaning solutions, and other undesirable liquids (e.g., contaminants such as paint thinner, paint, motor oil, or chemicals that may be poured into a urinal or toilet.) Thus, unlike a date label, or a date marking performed with a pen or marker that may deteriorate, fall off, disintegrate, erode or fade away, the date feature 20 will clearly indicate the installation or expiry date of the urinal screen 11.

For example, a facilities maintenance manager should have more control over the workers that clean the urinals, since the manager will know precisely when a screen 10 was replaced, and whether the workers actually replaced the screen 10 or not. This also likely removes any confusion relating to the age or condition of the screen 10, since it will have an installation or expiry date indicated on it, as opposed to situations where a label or pen marking was made on the urinal screen, which would likely have deteriorated or eroded. Moreover, the regular replacement of the urinal screen 10 will likely result in a better smelling and more sanitary restroom. Urinal screens typically look the same shortly after installation (e.g., 15 days) and after a period of time (e.g., 75 days). They may shrink slowly and become dirty, but it may be difficult to ascertain the age of the urinal screen and when it should be replaced. If a urinal screen has a fragrance, even the strength of the fragrance smell may not be sufficient to determine whether the urinal screen should be replaced. While urinal screens typically lose their fragrance over time, the maintenance personnel may be accustomed to the fragrance (perhaps from a neighboring urinal) and it may be difficult to determine the strength of the fragrance of a particular urinal screen, and ultimately the age of the urinal screen. Moreover, it may be unsanitary to use one's nose to determine whether to change a urinal screen. Further, the date feature 20 may give users, who are likely customers or workers in the establishment, confidence that the restroom is properly maintained, regularly maintained according to a schedule, and in a sanitary condition—all of which may in turn boost productivity or sales.

The date tabs 22 depicted in FIG. 1 are circular and reveal a circular hole when removed. Other shapes may be used, such as a triangle, oval, square, rectangle, or any polygon or closed curved shape. Different shapes may be used for different days, dates, weeks, months, years or quarters. Instead of the scheme discussed above where the installation (or expiry) month FEB is removed, all date tabs 22 other than the FEB date tab may be removed. Further, in addition to the perforation discussed above, other molded-in features can be employed to allow for separation or indication of the proper date using the date tabs 22. In another embodiment, the date tabs 22 are precut from their corresponding openings 23 except for a small portion, which is designed as a living hinge. Thus, the proper date can be indicated by pushing down on one of the date tabs 22, which will remain in place and reveal the opening 23. In another embodiment, the date tabs 22 are precut from their corresponding openings 23 except for two small ribs (or connectors) that connect the date tabs 22 to the screen body 11.

The body 11 (which may or may not include the date feature 20 or date tabs 22) of the urinal screen 10 may be formed from a plastic material that is loaded with a fragrance material. As used herein, the term "plastic" means any type of polymer, including synthetic or natural polymers. The polymers that may be suitable include both thermoplastic and thermoset polymers. Some examples of polymers that may be suitable are synthetic resins. Some particular examples of thermoplastic resins that may be suitable for forming the body 11 of the urinal screen 10 include ethylene vinyl acetate (EVA), polyvinyl chloride (PVC), polyethylene (PE), polypropylene (PP), polymethylpentene (NIPX), ethylene-(meth)acrylate ester copolymers, acrylic-type vinyl resins such as polymethyl methacrylate (PMMA), styrene-type vinyl resins such as polystyrene (PS), acrylonitrile-butadiene-styrene (ABS) copolymers, acrylonitrile-styrene (AS) copolymers, other vinyl resins such as polyvinyl acetate, polyvinylidene chloride (PVDC), polyvinyl alcohol (PVA), and polytetrafluoroethylene (PTFE), polyester resins such as polybutylene terephthalate (PBT) and polyethylene terephthalate (PET), polyamide resins such as nylon 6, nylon 66, nylon 610, nylon 11, and nylon 12, polyoxyalkylene resins such as polyacetal (POM), and other thermoplastic resins such as polycarbonates (PC), modified polyphenylene ethers (modified PPE), polyvinyl acetates (PVAC), polysulfones (PSU), polyethersulfones (PES), polyphenylene sulfides (PPS), polyarylates (PAR), polyamideimides (pAI), polyetherimides (PEI), polyetheretherketones (PEEK), polyimides (PI), as well as copolymers of the preceding. Combinations of different plastics can also be used to produce the body 11 and date tabs 22 of the urinal screen 10. Further, different plastics can be used to produce different portions of the body 11, date feature 20 and date tabs 22 of the screen 10.

In some embodiments, the plastic material that is used to form the body 11, date feature 20 and date tabs 22 has a melting point not greater than about 250° F., or not greater than about 225° F., or not greater than about 200° F. The use of a low melting polymer allows lower molding temperatures during manufacture, and can reduce the amount of loss of fragrance that can occur during the molding process.

Further, in some embodiments, the plastic material that is used to form the urinal assembly (e.g., the body 11, date feature 20 and date tabs 22, and other features) or urinal mat may be capable of resisting the harsh environment within a urinal (or inside a toilet, or on the bathroom floor), which may contain urine, waste products, cleaning solutions, and other undesirable liquids (e.g., contaminants such as paint thinner, paint, motor oil, or chemicals that may be poured into a urinal or toilet.) In some embodiments, the plastic material of the urinal assembly or urinal mat, and the urinal assembly or urinal mat itself, may be designed to maintain a near-pristine condition (evident after a water rinse or basic cleaning operation), without discernable wear for a long period of time, or large amount of uses and flushes. Thus, it may be said that the urinal assembly or urinal mat resists damage or alteration due to the environmental conditions within a urinal or bathroom. In other embodiments, the plastic material of the urinal assembly or urinal mat, and the urinal assembly or urinal mat itself, may be designed to last a certain amount of time, level or amount of use, or number of flushes, without exhibiting any wear (e.g., tearing, discoloring, disintegration, deformation, shrinkage, loss of scent) for that specified time/usage/period. For example: the lasting time may be 30 days, 60 days, 90 days, 6 months, or perhaps 1 year; the level or amount of use may be 100, 500, 1000, 5000, 10000, or perhaps 50000 uses (e.g., urinations); the number of flushes may be 100, 500, 1000, 5000, 10000, or perhaps 50000 flushes. In other embodiments, the plastic material of the urinal assembly or urinal mat, and the urinal assembly or urinal mat itself, may be designed to purposefully start exhibiting wear after the aforementioned predetermined amount of time/usage/period, such that the urinal assembly or urinal mat starts to tear, discolor, disintegrate, deform, shrink, or lose scent, which may alert maintenance personnel to replace the urinal assembly or urinal mat.

Figure 2:
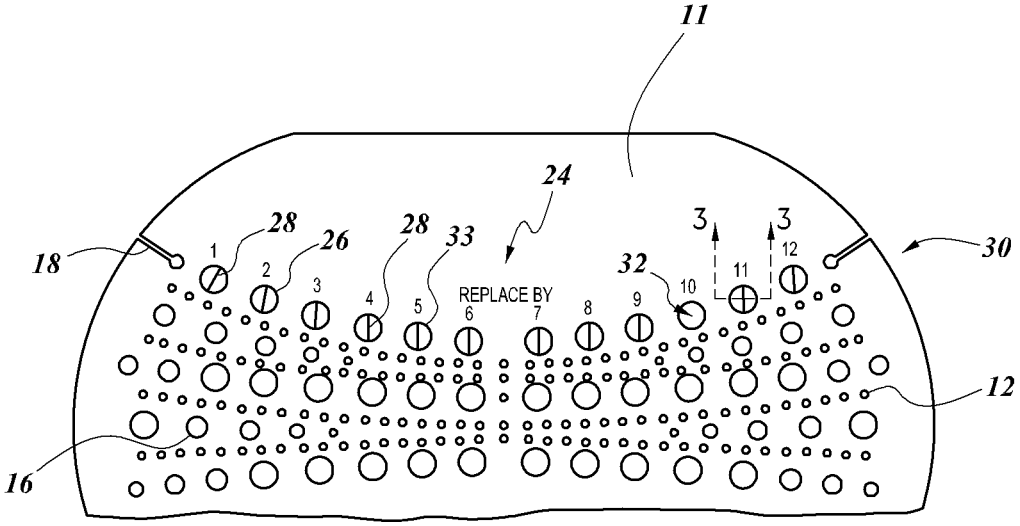
FIG. 2 is a plan view of a top portion of an embodiment of a urinal screen having a date feature that has month tabs.

FIG. 2 depicts a rear end of an embodiment of a urinal screen 30 having a date feature 24. Date feature 25 shows an alternative date feature 24 that comprises individual numeric month date tabs 26 corresponding to the twelve months of the year, in contrast to the alphabetic, abbreviated month date tabs 22 shown in FIG. 1.

Date tabs 26 may have a pull tab 28. In FIG. 2, the urinal screen 30 has its 10th month (i.e., October) date tab 26 removed. This exposes a circular opening 32 or a divot 33 (see FIG. 3) below. Like in the embodiment of FIG. 1, this indicates that the screen 30 was last installed in October, or that is expected to be changed in October. The pull tab 28 can be a one-piece construction with the substrate 31 of the date tab 26 and generally protrudes upwards from the substrate 31, but is not required to be vertical or perpendicular to the substrate 31. Instead of an opening 32 or hole, removing the date tab may expose a divot 33. FIG. 3 shows a screen body 11 with a divot 33 underneath a date tab 32. The divot 33 may be made to standout from the surrounding screen body 11 by using a different color, material or surface finish. The divot may also be the same, color, material or surface finish as the screen body 11. For example, a double injection process may be used where a layer of different colored material, different surface finish, or different material is placed in the divot 33. This contrast with the screen body 11 may provide a clearer indication of the installation or expiry date, in this case, October.

In some embodiments, the divot 33 has an ink layer that changes color due to exposure to certain liquids, such as urine or water. For example, in one embodiment, the divot 33 has an ink layer, which contains various additives that change color over time that would indicate the end of useful life of the product. One example of such an additive is one that changes color over a certain amount of light exposure (e.g., turns blue after 30 days of light exposure.) This divot 33 may be sealed from the environment when the date tab 26 is in place, but will be exposed if the date tab 26 is removed. For example, if a date tab 26 is removed, the ink layer may turn from one color to another after a period of usage to indicate that it is time for replacement of the urinal screen 30. In other embodiments, the divot 33 may be made of a water or urine soluble material that slowly dissolves. For example, when a date tab 26 is removed, the divot 33 is exposed to the liquids within a urinal/toilet and may dissolve completely after a period of time to indicate that it is time for replacement of the urinal screen 30. In another embodiment, the color change may be due to a change in the pH of the material of the divot 33 as the evaporation process proceeds.

Like the date tabs 22 shown in FIG. 1, the date tabs 26 may be molded in or co-molded as a unitary construction with the screen body 11, and may be the same or different material, color or surface finish as the screen body 11. The date tabs 26 and underlying divots 33 and openings 32 may have any shape, such as a circle, square, rectangle, triangle, oval, any polygon and any closed form shape.

FIG. 4A depicts an embodiment of a urinal screen 40 having a date feature 41 similar to that of the date feature 20 as shown in FIG. 1. In this embodiment, the date tabs 42 are discs generally corresponding in shape to the openings and may be each connected to the screen body 11 by two connecting spans, webbing, members or ribs 43, and may be pulled off or pushed through, for example, with a pencil or other tool. This may expose an opening 45, which would indicate when the screen 40 was last installed or when it is expected to be changed. This embodiment further has a "days of a month" date feature 46 that can be used independently or in conjunction with the month date tabs 42. The date feature 46 has day tabs 48, each of which is attached to the screen 40 with its own individual tab rib 49 or connector. The days tabs 48 comprise the numbers from one (1 or 01) to thirty-one (31), corresponding to the specific days of a month. In some embodiments, these day tabs 48 are placed on the periphery of the screen 40. There may be one, two, or more ribs 43 and 49 respectively connecting each of the month tabs 42 and day tabs 48 to the screen body 11. In another embodiment, instead of openings 45, a divot 44 may be underneath and revealed when a date tab 42 is removed.

Figure 4B:
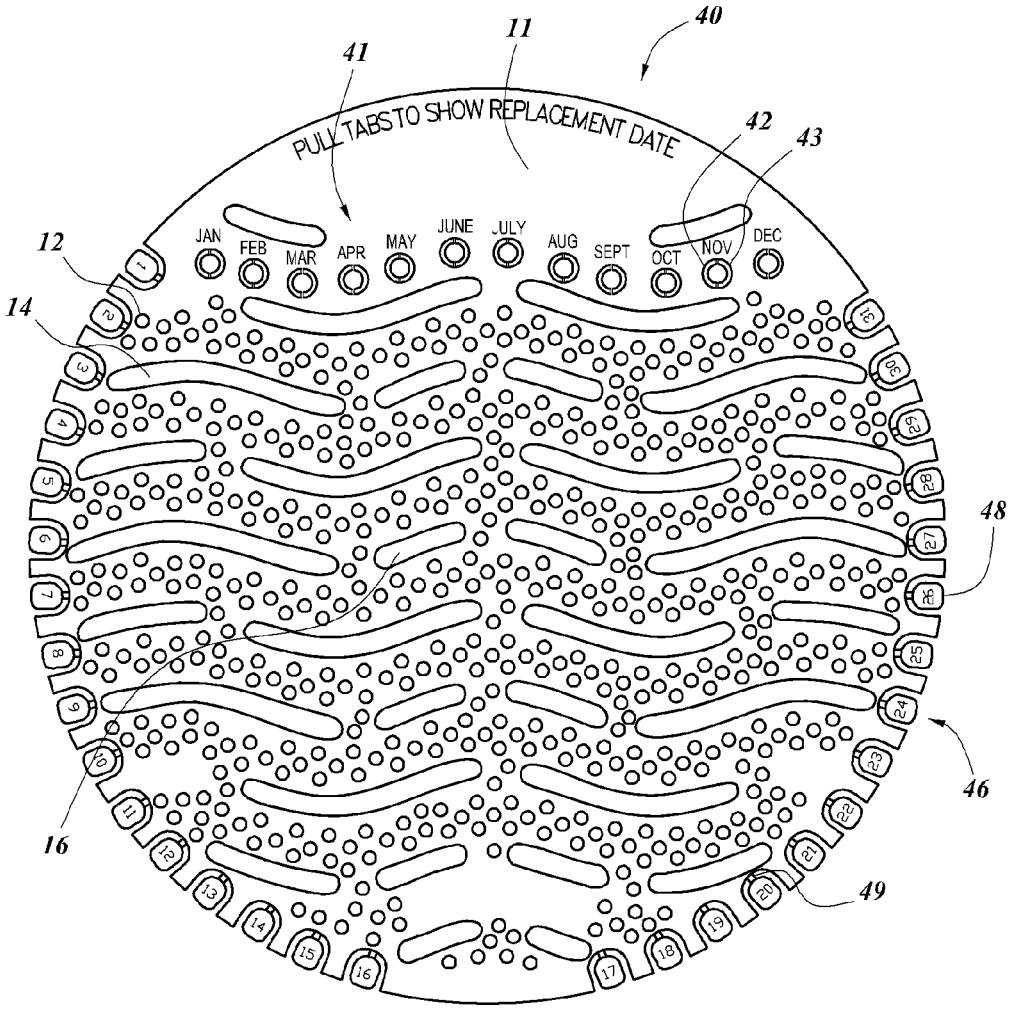
FIG. 4B is a plan view of an embodiment of a urinal screen having a date feature that has month and day tabs.

FIG. 4B shows another embodiment of a urinal screen 40, having a date feature 41. The date tabs 42 are attached to the screen body 11 by ribs 43. In FIG. 4B, no date tabs 42 have yet been removed. The screen body 11 also has day tabs 48 attached via ribs 49 and are located on the periphery of the screen body 11.

Figure 5:
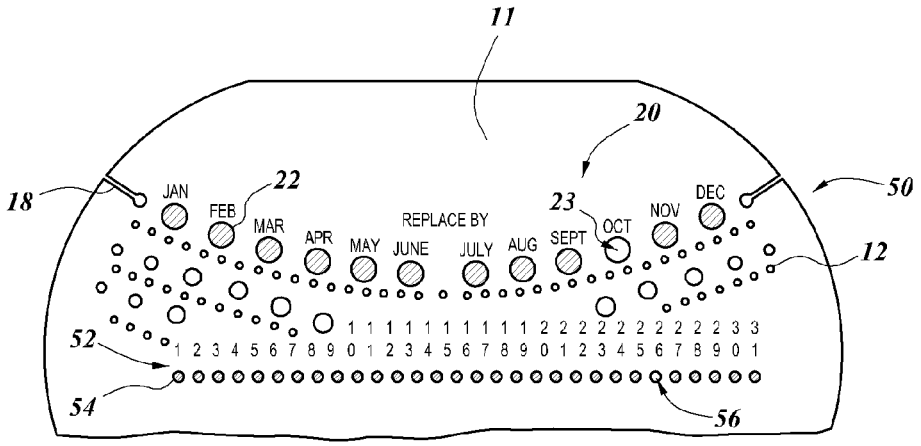
FIG. 5 is a plan view of a top portion of an embodiment of a urinal screen having a date feature that has month and day tabs.

FIG. 5 shows a rear end of an embodiment of a urinal screen 50 with the date feature 20 having multiple alphabetic month date tabs 22. The date tabs 22 are shaded to indicate that they are attached to the screen body 11 except for the "OCT" date tab, which has been removed, exposing an opening 23. Also depicted is a date feature 52 made up of day tabs 54. The day tabs 54 correspond to the days of a month indicated above in numbers from 1 to 31. In this example, the day tabs are shaded to indicate they are attached to the screen body 11 except for the "26" day tab (e.g., exposed opening 56), to indicate that October 26 is when the screen 50 was installed or when the screen 50 should be removed.

Figure 6:
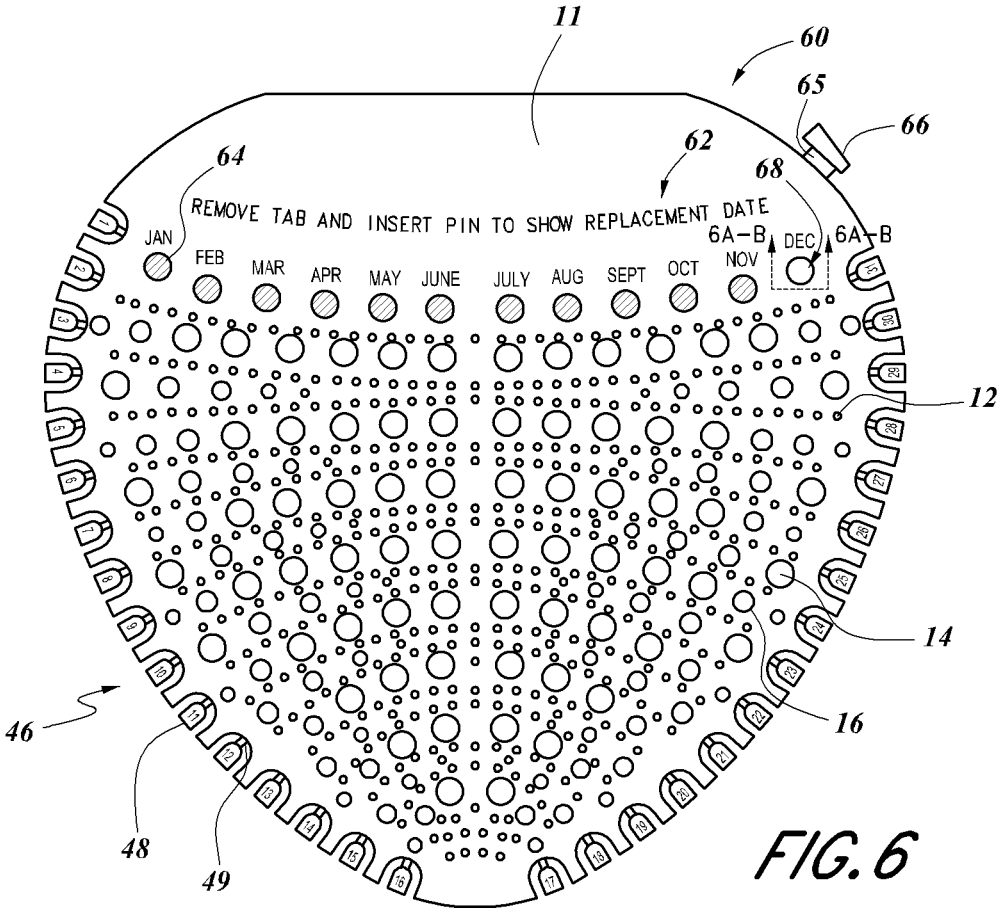
FIG. 6 is a plan view of an embodiment of a urinal screen having a date feature that has a date pin.
Figure 6A:
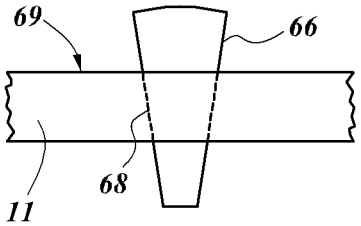
FIG. 6A-6B are a cross-sectional views of section 6A-B in FIG. 6, showing various embodiments relating to the date pin.
Figure 6B:
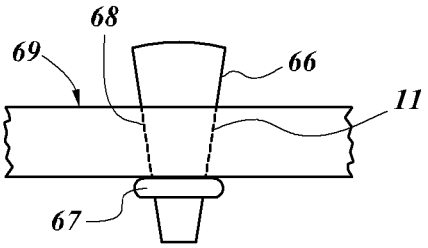

FIG. 6 illustrates an embodiment of a urinal screen 60 having a more positive feature to identify a date tab. Similar to the embodiment shown in FIG. 4A, the screen 60 has a screen body 11 with a date feature 62 having date tabs 64 corresponding to months of a year, and a second date feature 46 having date tabs 48 corresponding to days of a month. Further, the urinal screen 60 has a date pin 66, attached to the screen body 11 by a rib 65. As shown in FIGS. 6A and 6B, the date pin 66 can be removed (e.g., cut off, pulled off, twisted off) from the screen body 11, and inserted into an opening that becomes exposed when the date tab 64 is removed. In this example, the date tab for "DEC" has been removed, exposing opening 68. The date pin 66 is placed into the opening 68 to give indication that December is the installation month, or the expiry month.

The date pin 66 may have a longitudinal axis extending from a proximal end of the pin to a distal end of the pin, and may be tapered along the longitudinal axis. This taper may assist in securing the date pin 66 within the opening 68, where the harder the date pin 66 is pushed into the opening 68, the better it will be retained. FIG. 6B shows another embodiment, where the date pin 66 has a protrusion 67 along part of the surface of the pin 66, such that the protrusion helps lock the pin 66 into the opening 68. The protrusion or protrusions do not need to be continuous or completely circumscribe the pin 66. Generally, the protrusion or protrusions may extend in a direction perpendicular to the longitudinal axis of the pin 66. Like the date tabs 22 described above, the date pin 66 may have the same or difference color, material, or surface finish as the screen body 11.

Figure 7:
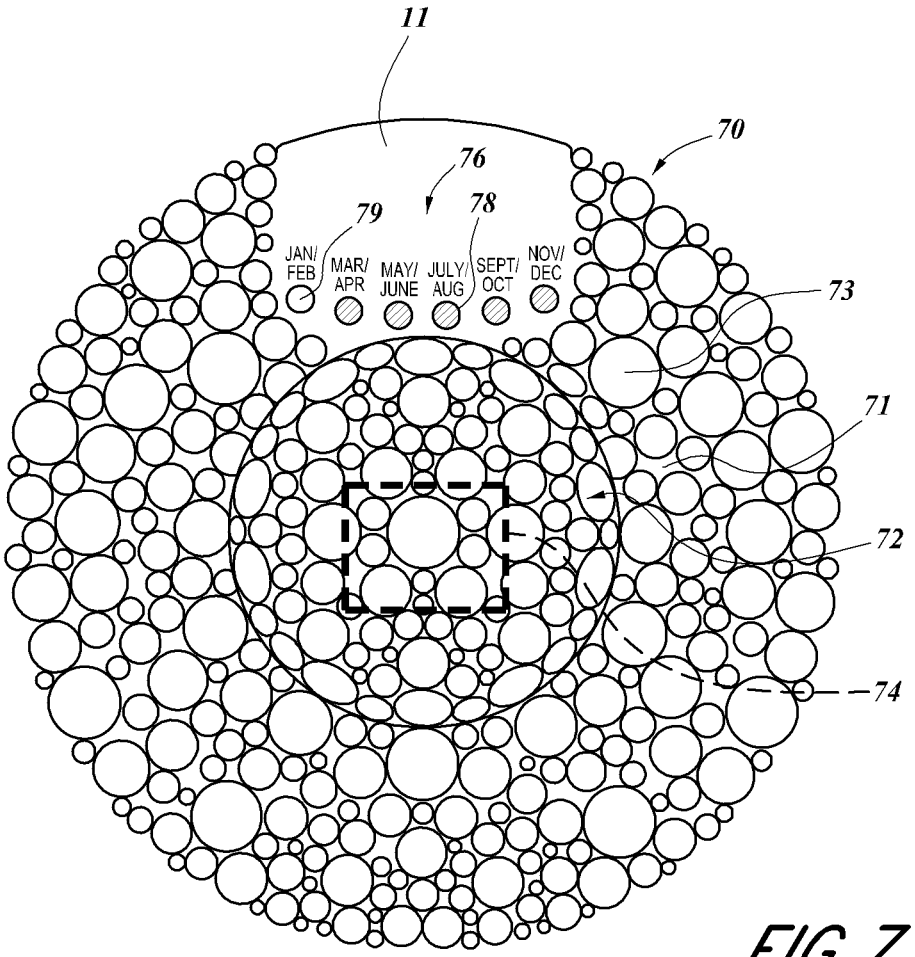
FIG. 7 is a plan view of an embodiment of a urinal screen having a date feature that has month tabs.
Figure 7A:
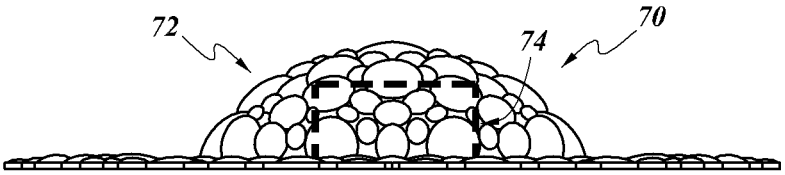
FIG. 7A is a side view of the urinal screen in FIG. 7.

FIGS. 7 and 7A show an embodiment of a urinal screen 70 having a pocket 72 wherein a fragrance block 74 is disposed. The fragrance block 74 is utilized to at least deodorize and possibly sanitize the urinal for at least a portion of a restroom. The urinal screen 70 has a screen body 11 that may be made up of different shaped and sized pieces 73, which may be of the same or different color, material or surface finish. These pieces 73 may be attached or molded together (i.e., molded at the same time) to form a unitary body, which may have openings 71 formed between the pieces 73. The screen 70 also has a date feature 76 that has date tabs 78. In this embodiment, the dual consecutive monthly alphabetic date tabs 78 are individually identified as the dual consecutive months JAN/FEB (removed to reveal opening 79), MAR/APR, MAY/JUNE, JULY/AUG, SEPT/OCT, and NOV/DEC.

Figure 8B:
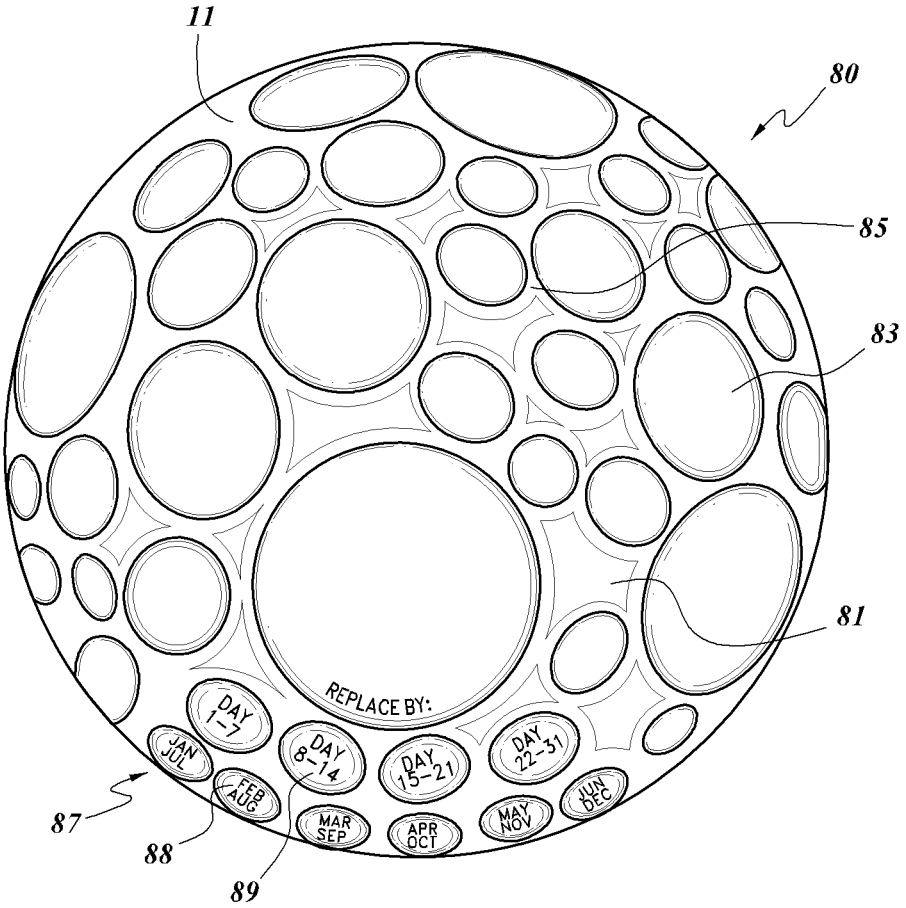
FIG. 8B is a plan view of an embodiment of a urinal screen having a date feature that has month and day tabs shaped as domes.

FIG. 8A shows another embodiment of a urinal screen 80 having a screen body 11. In this embodiment, domes or craters 83 are connected together by a webbing 85. In some embodiments, the screen body 11 may have domes 83 that are shaped like a portion of a sphere and protrude from the surface of the screen body 11. In other embodiments, the screen body 11 may have craters 83 that are shaped like a portion of a sphere and are depressed into and underneath the surface of the screen body 11. The domes or craters 83 may also be of any other three-dimensional shape, such as cubes or boxes. In some areas of the webbing 85, there may be openings 81 that allow liquid to drain through the screen body 11. The urinal screen 80 also has a date feature 87, which may include date tabs 88 connected to the screen body 11 via ribs 82. In the example shown, the date tabs 88 are correspond to a range of dates, and the months are overlapped in 6 month intervals. For example, if the "JAN JUL" month date tab is removed, that may indicate an installation or expiry date of January or July. Combining ranges of days and multiple months may save space on the urinal body 11. FIG. 8B shows an embodiment similar to that of FIG. 8A, but where the date tabs 88 are not connected via a rib, but instead are shaped into domes. Thus, to indicate the desired date, the installer may push down the dome-shaped date tabs 88 corresponding to the desired date, to form a crater. This pushing down of a dome to form a crater is similar to that performed on the lids of fountain drinks, which employ similar domes as indicia. The urinal screen 80 may be formed as a unitary body comprised of one material, color or surface finish, or it may be made up of different materials, colors or surface finish for each of the domes/craters 83 and webbing 85. Further, the urinal screen 80 may be made up of different materials, colors or surface finish for each of the domes/craters 83 and webbing 85, but still be formed or molded together at the same time as a unitary construction.

Figure 9:
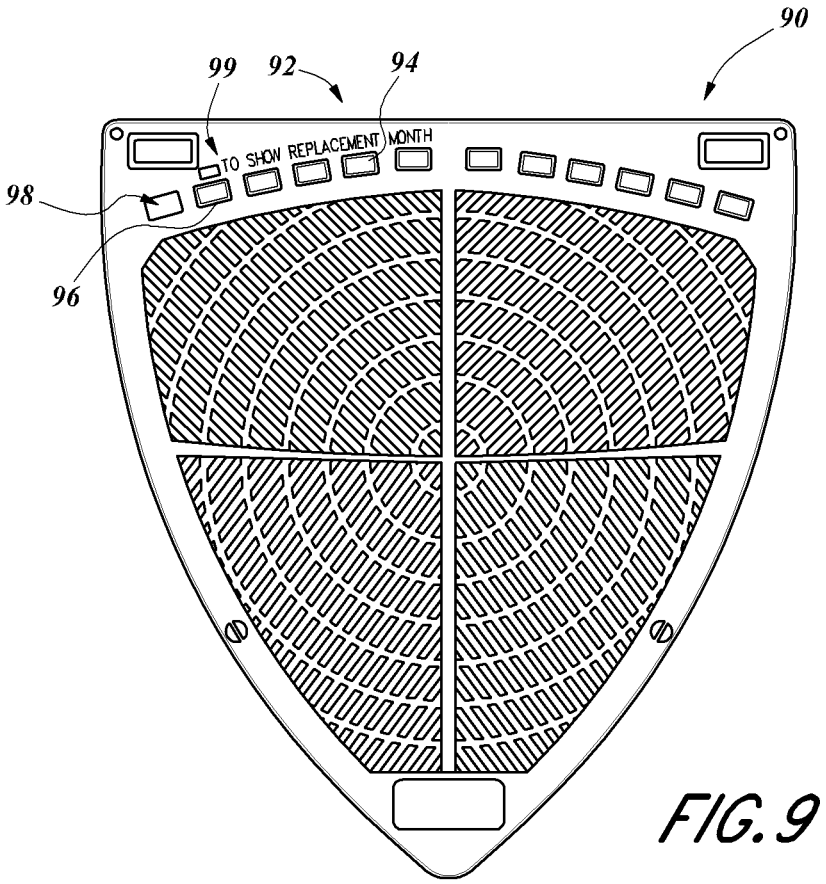
FIG. 9 is a plan view of an embodiment of a urinal mat having a date feature that has month tabs.

FIG. 9 shows an embodiment of a urinal mat 90 that has a date feature 92 where the individual months of JAN-DEC are individually indicated on a side of each rectangular date tab 94 which has a tab connector 96 that can be provided on any side of the date tabs 94. The date tabs 94 can be broken off and discarded, revealing an opening 98 in the mat 90, shown in this example for the month of January (JAN). The tabs 94 can also be of a material that permits the tabs 94 to be bent up at an angle with respect to the surface 99 of the mat 90, but remain connected with the mat 90.

Figure 11:
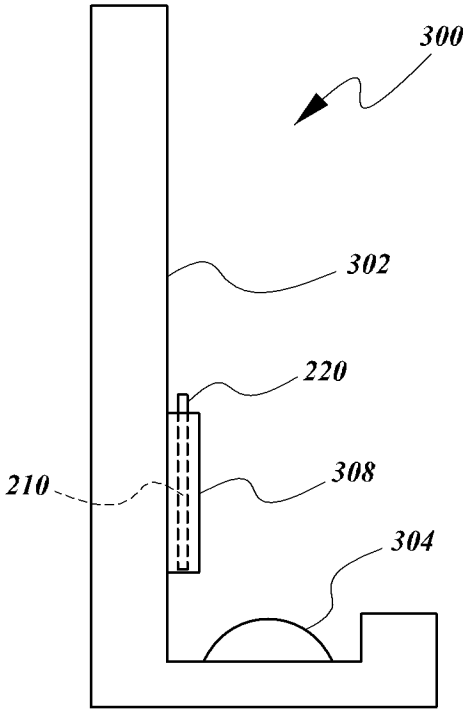
FIG. 11 is a schematic view of a urinal screen installed within a slot on the back wall of a urinal.
Figure 10:
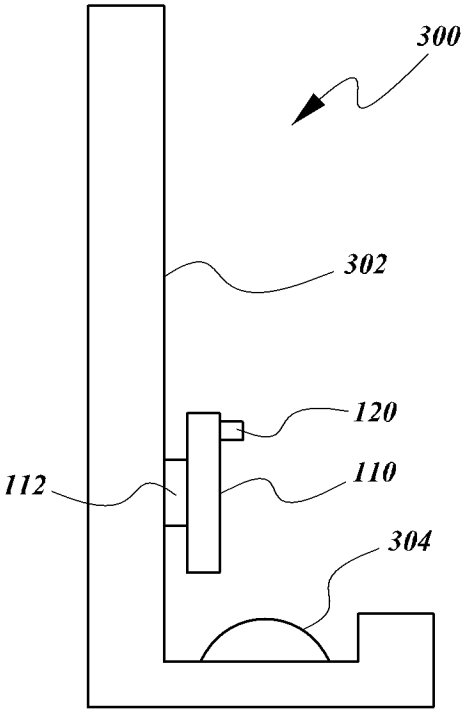
FIG. 10 is a schematic view of a urinal screen installed on the back wall of a urinal.

In some embodiments, a urinal screen can be configured to be installed on the back wall of a urinal, as illustrated in FIGS. 10 and 11. For example, FIG. 10 illustrates a urinal 300 having a back wall 302 onto which a urinal screen 120 is installed using an attachment structure 112. The attachment structure 112 can be one or more suction cups attached to or integrally formed with the urinal screen 120. In some variants, the attachment structure 112 is a protrusion or other structure on the back of the urinal screen 120 configured to releasably engage (e.g., snap fit, screw fit, magnetically engage) with a corresponding mating feature on the back wall 302 of the urinal 300. The urinal screen 110 and/or attachment structure 112 can be configured such that a date feature 120 on the urinal screen 110 remains visible to the maintenance provider when the urinal screen 110 is attached to the back wall 302 of the urinal 300.

FIG. 11 illustrates a urinal 300 having a screen receiving structure 308. The screen receiving structure 308 can be a pocket (e.g., a pocket with one or more perforated or otherwise permeable walls), a pair of slots, a shelf (e.g., a shelf with one or more lips along the edges of the shelf), or any other structure configured to support a urinal screen 210 upon a back wall 302 of the urinal 300. The screen receiving structure 308 can be adapted to support the urinal screen 210 while maintaining visibility of a date feature 220 of the urinal screen 210.

Figure 12:
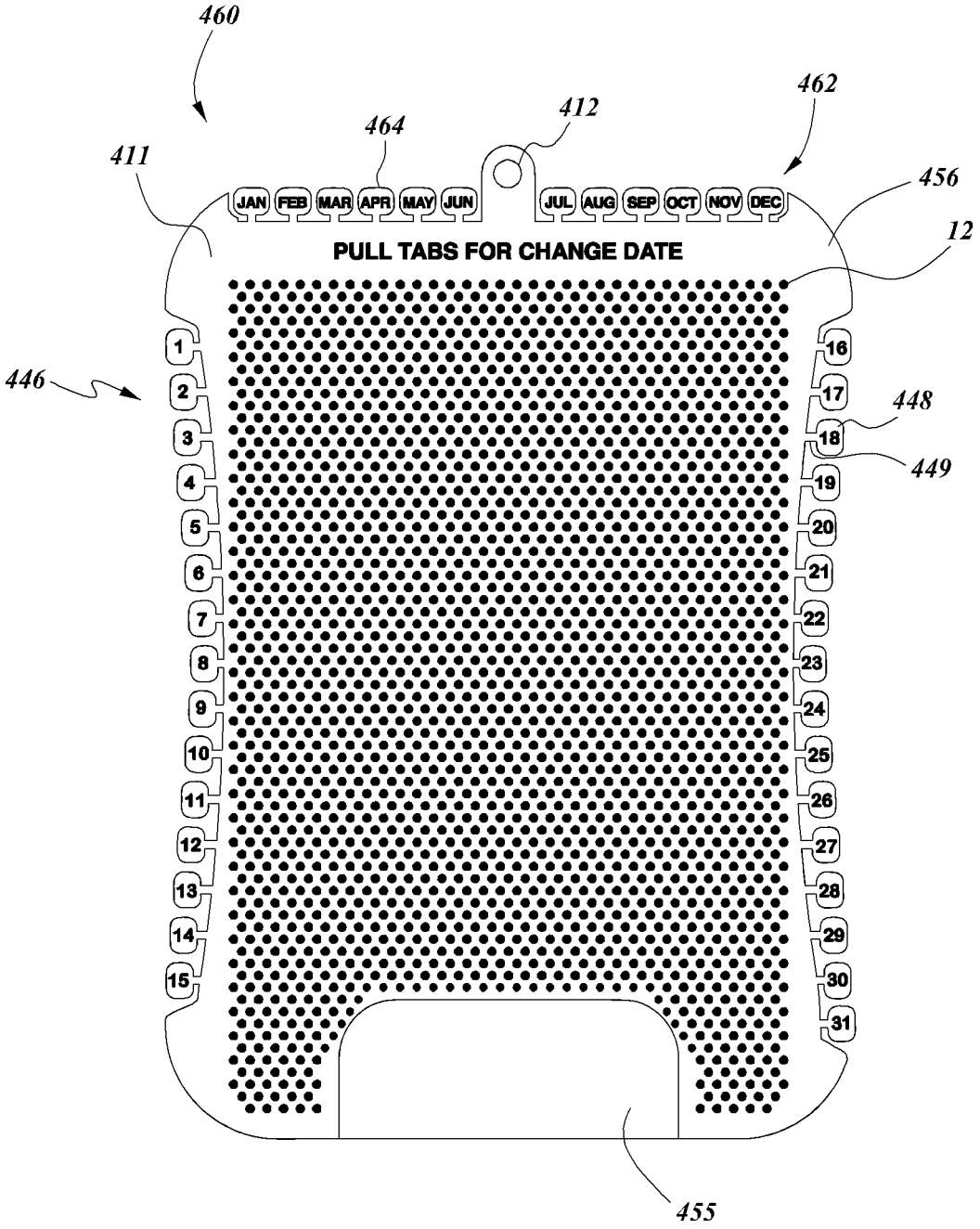
FIG. 12 is a plan view of an embodiment of a urinal screen having a date feature and an attachment structure.
Figure 13:
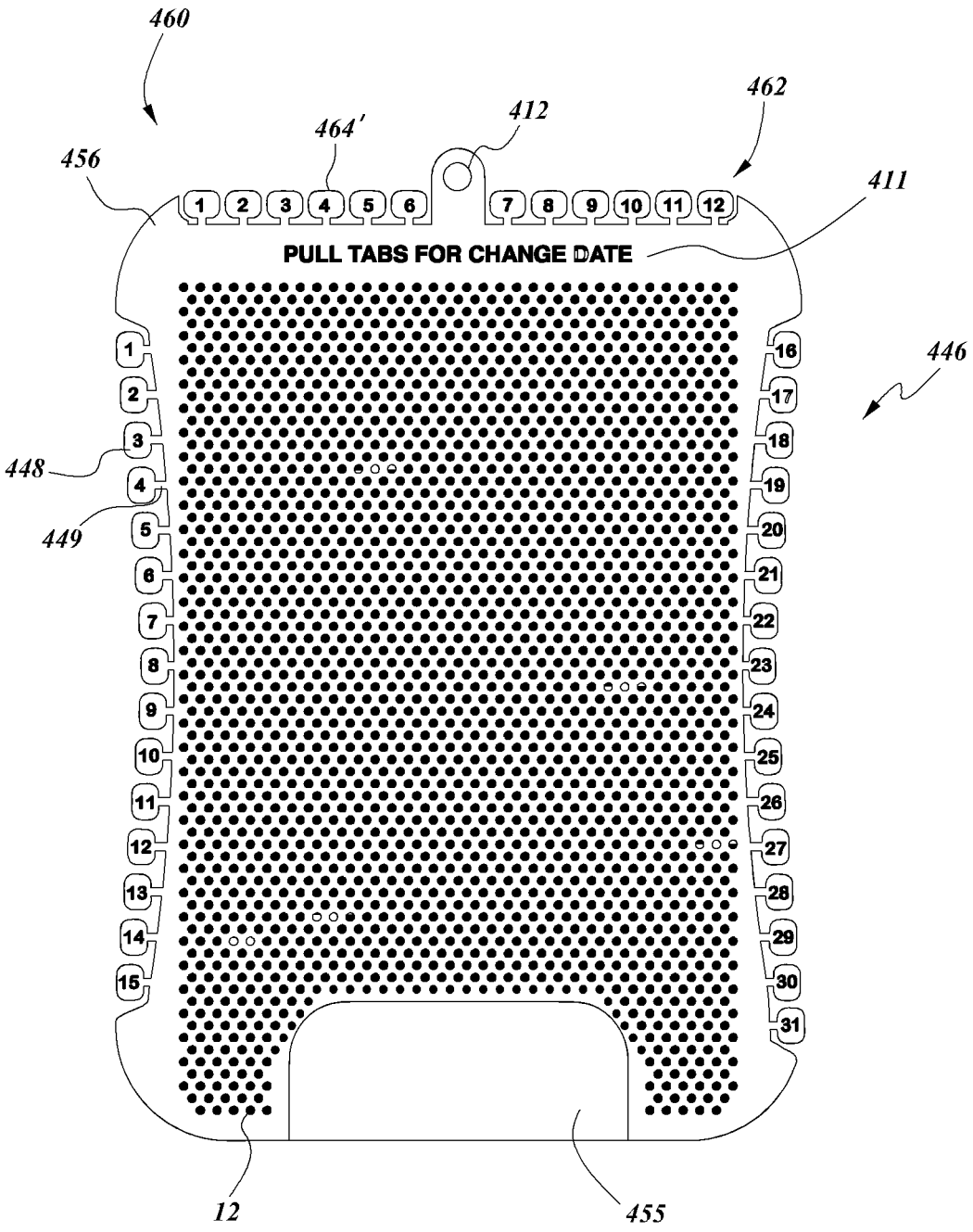
FIG. 13 is a plan view of another embodiment of a urinal screen having a date feature and an attachment structure.

As illustrated in FIG. 12, in some embodiments, a urinal screen 460 can have a screen body 411. The screen body 411 can include a plurality of openings or protrusions 12 on at least one side of the screen body 411. The urinal screen 460 can include an attachment structure 412. The attachment structure 412 can be a hang hole configured to releasably engage with a hook or other protrusion on the back wall 302 of a urinal 300. In some embodiments, the attachment structure 412 is a suction cup configured to releasably engage with the back wall 302 of a urinal 300. The screen 460 can include one or more protrusions 456 configured to reduce splashing. One or more date features can be located on a side and/or around the periphery of the screen body 411. These date features can be located such that they remain visible to a maintenance provider when the screen 460 is attached to a urinal 300. In some embodiments, the screen 460 includes a first date feature 462 having tabs 464 or other interactive features that indicate a month of the year. For example, each of the tabs 464 can display a full or abbreviated name of a month. The screen 460 can include a second date feature 446 having tabs 448 with tab ribs 449. The tabs 448 can correspond to the days of the month. The screen body 411 can include an open area 455. The open area 455 can be configured to receive adhesive labels or other visual feature (e.g., advertisements). In some embodiments, as illustrated in FIG. 13, the screen 460 can include date tabs 464' that correspond to months of the year by corresponding number 1-12 (e.g., 1 for January, 2 for February, and so on).

In some embodiments, a plurality of urinal screens can be used in a urinal 300. For example, a urinal screen 110, 210, 460 can be placed on the back wall 302 of the urinal 300 and an additional urinal screen 110, 210, 460 can be placed adjacent to or covering a drain 304 of the urinal 300.

One method of manufacturing an embodiment of the invention includes providing plastic or EVA material, which may have a melting point of not greater than 250° F., loading the plastic or EVA with at least 15% to about 75% by weight of fragrance material to produce a fragranced plastic or EVA, loading the fragrance at a stage conducted at temperatures such that the fragranced plastic or EVA is from at least 15% by weight fragrance upon completion of the loading stage, and molding the fragranced plastic or EVA into a urinal screen, sized and shaped to be disposed in a urinal, forming openings in the screen body, and forming date tabs which collectively form a date feature.

The date features, date tabs and date pins described herein are not limited to their location and can be located anywhere on their respective screen/mats, and achieve some of the advantages of the invention. The construction of the date tabs, date pins, associated openings, divots, domes, craters, ribs, connectors may be interchanged with any of the embodiments of urinal screens and mats disclosed herein. For example, embodiments are not limited to the use of date tabs that require ribs to connect them to the screen body. Similarly, date tabs in the form of a dome (and without ribs or perforations) may be used on any embodiment. Design and placement of the date features, date tabs and date pins would be affected primarily by the aesthetic appeal of the screens and mats.

As an example of the use of urinal screens with a date feature: a janitor is instructed by a building supervisor to change all urinal screens and mats every two months. On the ninth of October, the janitor replaces the urinal screens and mats in all of the restrooms in the building while removing the DEC month date tab and also removing 9 from the day date tab to indicate the expiry date. A supervisor may perform a periodic check of all the restrooms to see if instructions are being followed, hoping to find that all urinal screens and mat have a expiry date later than December 9.

In general, labor associated with cleaning a restroom and changing out items like toilet paper, paper towels, and soap are more predictable since it is easy to see that these items are gone, which can be daily. With urinal screens, mats, and fragrance, it is not so easy since these materials are still present even after their ability to serve their purposes has gone. The various embodiments of urinal screens/mat with a date feature can assist in the proper determination of the age of, and replacement of the urinal screens and mats.

Further, some embodiments herein describe urinal screens and mats with a date function that is a single phase product, where the date feature is a unitary construction with the remainder of the screen body. The date function allows the end user to indicate an installation/expiry date, without the need for labels, pens or other marking devices which are prone to failure for reasons described above.

While the preferred embodiments of the present invention have been described above, it should be understood that they have been presented by way of example only, and not of limitation. It will be apparent to persons skilled in the relevant art that various changes in form and detail can be made therein without departing from the spirit and scope of the invention. Thus the present invention should not be limited by the above-described exemplary embodiments, but should be defined only in accordance with the following claims and their equivalents. Furthermore, while certain advantages of the invention have been described herein, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

What is claimed is:

1. A urinal assembly, comprising:

a screen body sized and shaped to be placed in a urinal;

wherein the screen body is configured to extend over a portion of the drain portion of the urinal;

the screen body defining at least one opening;

a date feature comprising at least one date tab associated with indicia corresponding to a time or time interval, wherein the at least one date tab is removably attached to the screen body;

wherein the date feature and the at least one date tab are made of a plastic, wherein the plastic resists damage or alteration due to the environmental conditions within a urinal.

2. The urinal assembly of claim 1, wherein the time or time interval comprises months of a year.

3. The urinal assembly of claim 1, wherein the time or time interval comprises days of a calendar month.

4. The urinal assembly of claim 1, wherein the time or time interval comprises weeks of a calendar year.

5. The urinal assembly of claim 1, wherein the time or time interval comprises quarters of a calendar year.

6. The urinal assembly of claim 1, wherein the at least one date tab is removably attached to the screen body by a living hinge.

7. The urinal assembly of claim 1, wherein the at least one date tab comprises a pull tab.

8. The urinal assembly of claim 1, further comprising a divot formed in the screen body, wherein the at least one date tab is removably attached to the screen body at a location above the divot, wherein upon removal of the at least one date tab, the divot is exposed.

9. The urinal assembly of claim 8, wherein the surface of the divot is of the same color as the screen body.

10. The urinal assembly of claim 8, wherein the surface of the divot is made of the same material as the screen body.

11. The urinal assembly of claim 1, wherein the removal of the at least one date tab results in an opening in the screen body.

12. The urinal assembly of claim 1, wherein the at least one date tab is removably connected to the screen body by a rib.

13. A urinal assembly, comprising:

a screen body sized and shaped to be placed in a urinal;

wherein the screen body is configured to extend over a portion of the drain portion of the urinal;

the screen body defining at least one opening;

the screen body defining at least one date opening associated with indicia corresponding to a time or time interval; and a date pin sized and shaped to be secured within the at least one date opening.

14. The urinal assembly of claim 13, wherein the time or time interval comprises months of the year.

15. The urinal assembly of claim 13, wherein the time or time interval comprises days of a calendar month.

16. The urinal assembly of claim 13, wherein the time or time interval comprises weeks of a calendar year.

17. The urinal assembly of claim 13, wherein the time or time interval comprises quarters of a calendar year.

18. The urinal assembly of claim 13, wherein the date pin is removably attached to the screen body.

19. The urinal assembly of claim 13, wherein the date pin further comprises a longitudinal axis extending from a proximal end of the pin to a distal end of the pin, wherein the date pin is tapered along the longitudinal axis.

20. The urinal assembly of claim 13, wherein the date pin further comprises a protrusion disposed on an outer surface of the date pin, sized and shaped to lock the date pin into the at least one date opening.

21. The urinal assembly of claim 13, wherein the date pin is of the same color as the screen body.

22. The urinal assembly of claim 13, wherein the date pin is made of the same material as the screen body.

23. A urinal assembly, comprising:

a screen body sized and shaped to be placed in a urinal;

wherein the screen body is configured to extend over a portion of the drain portion of the urinal;

the screen body defining at least one opening;

a date feature associated with indicia corresponding to a time or time interval, the date feature configured to physically manipulated to indicate a time or time interval;

wherein the date feature is made of a plastic, wherein the plastic resists damage or alteration due to the environmental conditions within a urinal; and wherein the date feature comprises at least one dome corresponding to a time or time interval, the at least one dome configured to collapse when pressed.

* * * * *